US005894749A

United States Patent [19]

Tomaszewski et al.

[11] Patent Number: 5,894,749

[45] Date of Patent: Apr. 20, 1999

[54] LATCHING SYSTEM WITH FLEXIBLE RELEASE

[75] Inventors: Kris Tomaszewski, Markham; Luda Uzdin, Newmarket, both of Canada

[73] Assignee: Atoma International Corp., Ontario, Canada

[21] Appl. No.: 09/141,028

[22] Filed: Aug. 27, 1998

Related U.S. Application Data

[62] Division of application No. 08/922,936, Sep. 3, 1997.

[51] Int. Cl.[6] ..... E05B 65/19

[52] U.S. Cl. ..... 70/240; 70/256; 70/422; 292/DIG. 43

[58] Field of Search ..... 70/422, 240, 241, 70/256, 257, DIG. 30, DIG. 52; 292/50, DIG. 38, 125, 225, DIG. 25, DIG. 43, 28, 171

[56] References Cited

U.S. PATENT DOCUMENTS

| | | | |
|---|---|---|---|
| 1,441,317 | 1/1923 | Walsh et al. | 70/256 |
| 1,570,797 | 1/1926 | Thomas et al. | 70/256 |
| 1,600,056 | 9/1926 | Morgan | 70/256 |
| 1,905,057 | 4/1933 | Riccini | 70/256 |
| 1,918,093 | 7/1933 | Gang | 70/256 |
| 2,548,242 | 4/1951 | Rosenbarger | 70/256 |
| 3,062,033 | 11/1962 | Schmalfeldt | 70/256 |
| 3,251,158 | 5/1966 | Shapiro | 292/125 X |
| 4,073,170 | 2/1978 | Miyabayashi et al. | 70/256 |
| 5,077,991 | 1/1992 | Stickel et al. | 70/DIG. 52 X |
| 5,233,849 | 8/1993 | Forbers | 70/256 |
| 5,358,292 | 10/1994 | Van Wiebe et al. | 292/125 X |

FOREIGN PATENT DOCUMENTS

| | | | |
|---|---|---|---|
| 2 161 854 | of 1986 | United Kingdom | 70/256 |

*Primary Examiner*—Lloyd A. Gall
*Attorney, Agent, or Firm*—Pillsbury Madison & Sutro LLP

[57] ABSTRACT

A flexible link connects a release pawl of a latch to key cylinder. The link has a connector at each end thereof for connecting to the release pawl at one end and for connecting to the key cylinder at the opposite end. The link has a flexing section intermediate of the ends. The flexing section has a bias for deflecting in a predetermined direction.

15 Claims, 6 Drawing Sheets

LATCHING SYSTEM WITH FLEXIBLE RELEASE

This is a division of application No. 08/922,536, filed Sep. 3, 1997.

FIELD OF THE INVENTION

This invention relates to a flexible release for a latching system. In particular, this invention relates to a flexible release connector operably joining a key cylinder and a latch assembly.

BACKGROUND OF INVENTION

A typical deck lid for a trunk of a vehicle will have a latch which is operable by a key cylinder. Operation of the key cylinder will rotate a lever which is linked to a release pawl of the latch. Rotation of the release pawl will release the ratchet or detent fork which grips a keeper of a striker plate on the body of the vehicle, thus opening the deck lid.

Optionally, the vehicle can be provided with an inside release handle which is operable from within the vehicle to allow the operator to open the trunk while remaining in the vehicle.

Still further, the vehicle can be provided with an actuator operably connected to the latch. The actuator has a receiver for receiving remotely transmitted signals and responsively rotates the release pawl to open the deck lid.

A conventional latch assembly, as illustrated in FIG. 1, will have the locking cylinder 12 connected to the release pawl 14 of a latch 16 by a flexible cable assembly 18 or a fixed link with some form of lost motion capabilities to accommodate the movement of the pawl as it ratchets with the detent fork 20 upon closing of the deck lid.

A cable assembly usually consists of a cable 22, a balled end 24, a ferrule 26 and a cable end 28. The pawl 14 must have a cooperative fitting 30 to receive the balled end 24 of the cable 22. The housing of the latch 16 must have a tab 32 for mounting the ferrule 26, through which the cable 22 extends, for controlling the angle of attack between the cable 22 and the pawl 14. The key cylinder lever 34 requires a clip 36 to attach the cable 22.

The cable assembly of the prior art has proven to be an effective operating connection between the locking cylinder 12 and the latch 16. However, the cable assembly requires considerable labor to assemble and then install. Further, the cable assembly has a number of parts, all of which are susceptible to failure and malfunction.

SUMMARY OF THE INVENTION

The disadvantages of the prior art may be overcome by providing a biased flexible link operably connecting a release pawl of a latch and a key cylinder.

It is desirable to provide a relatively inexpensive flexible link for operably connecting a release pawl of a latch to a lever of a key cylinder.

According to one aspect of the invention, there is provided a flexible link for operably connecting a release pawl of a latch to key cylinder. The link has a connector at each end thereof for connecting to the release pawl at one end and for connecting to the key cylinder at the opposite end. The link has a flexing section intermediate of the ends. The flexing section has a bias for deflecting in an axial or predetermined direction.

DESCRIPTION OF THE DRAWINGS

In drawings which illustrate embodiments of the invention.

DESCRIPTION OF THE INVENTION

Figure 1:
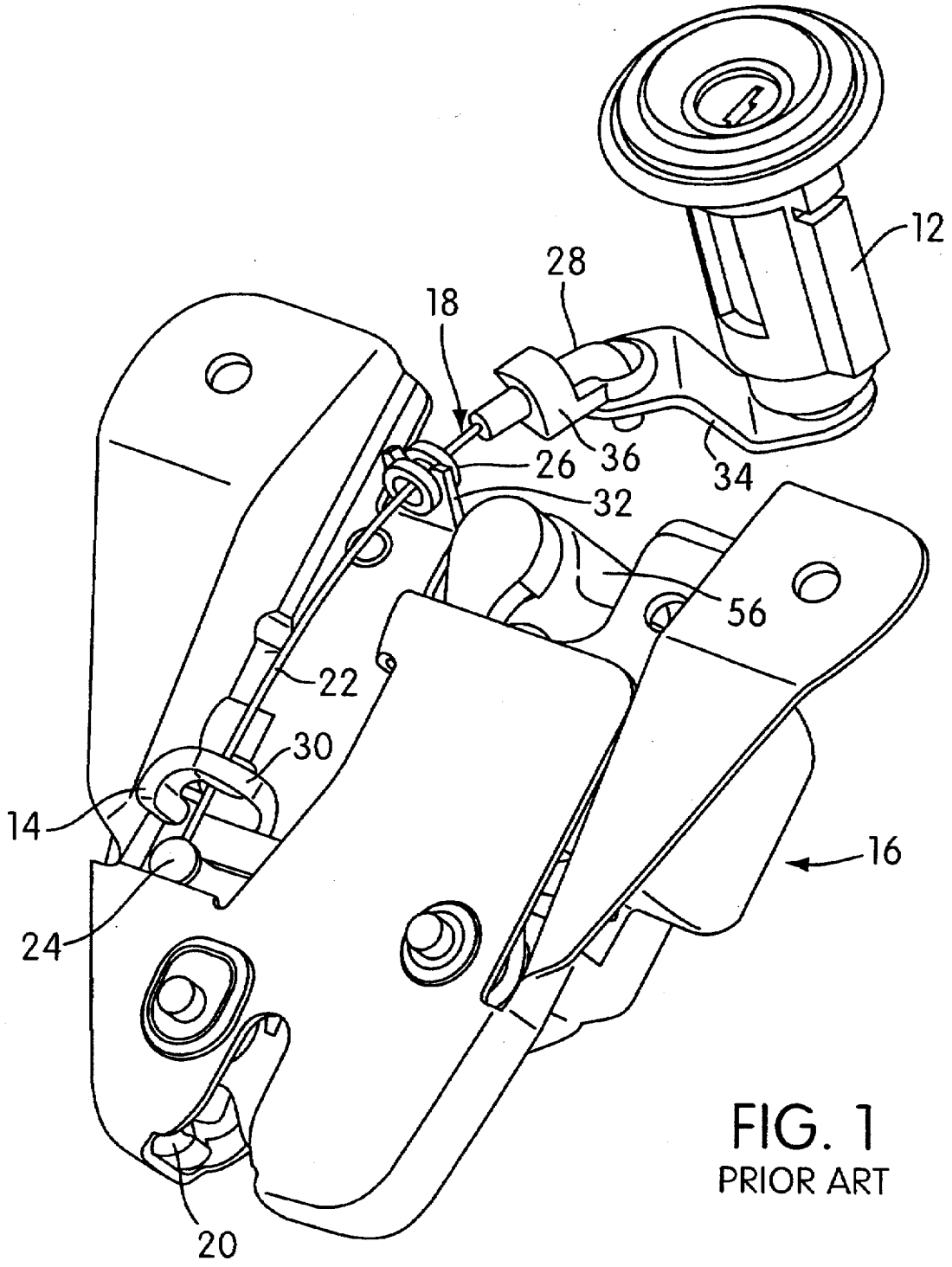
FIG. 1 PRIOR ART
FIG. 1 is a perspective view of a prior art latch assembly.
Figure 2:
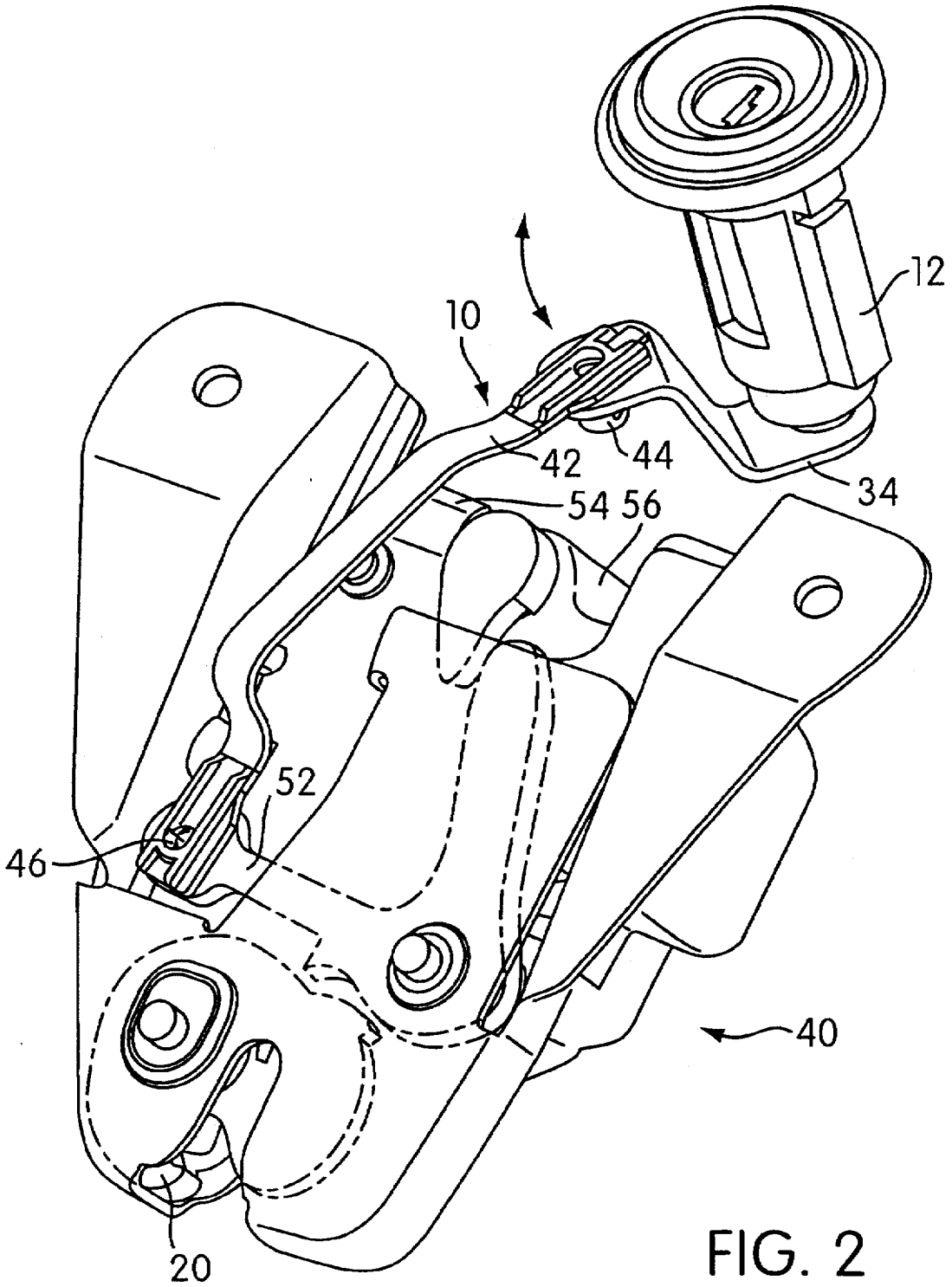
FIG. 2 is a perspective view of the latch assembly of incorporating the flexible link of the present invention, illustrating the latch assembly in a stand-by condition.

Referring generally to FIG. 2, a flexible link 10 of the present invention is illustrated. The flexible link 10 operably connects a key cylinder 12 to a latch 40. Key cylinder 12 is conventional. Latch 40 is identical to latch 16, as illustrated in reference to the prior art of FIG. 1, except as noted below. Like reference numerals identify identical parts of the prior art and the latch assembly incorporating the present invention.

Figure 3:
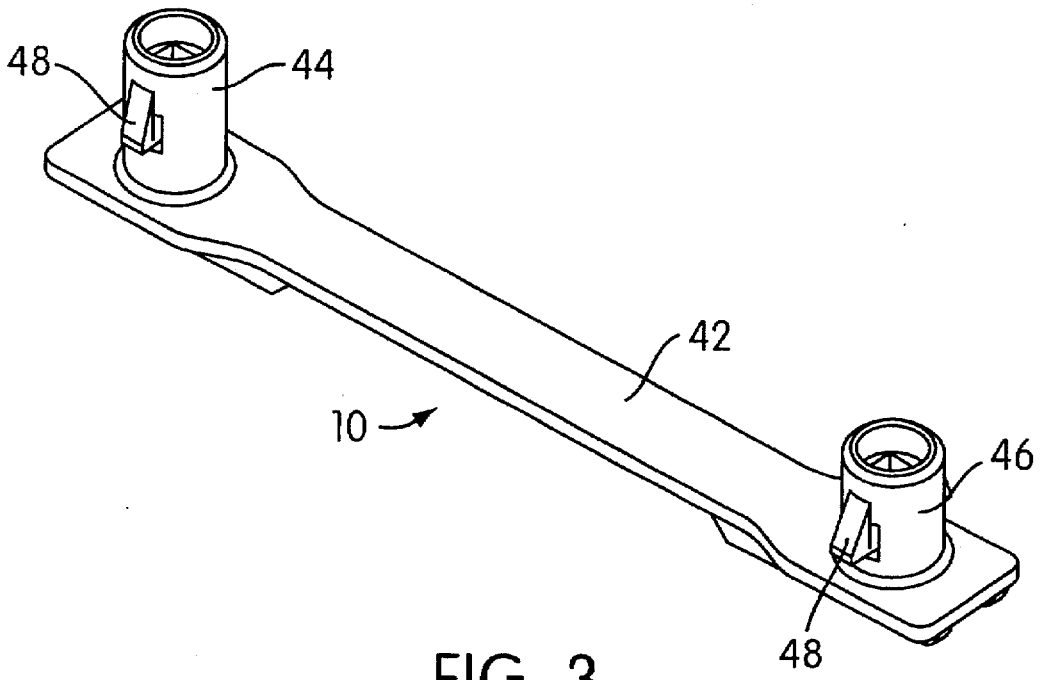
FIG. 3 is a perspective view of the underside of the flexible link of the present invention.
Figure 4:
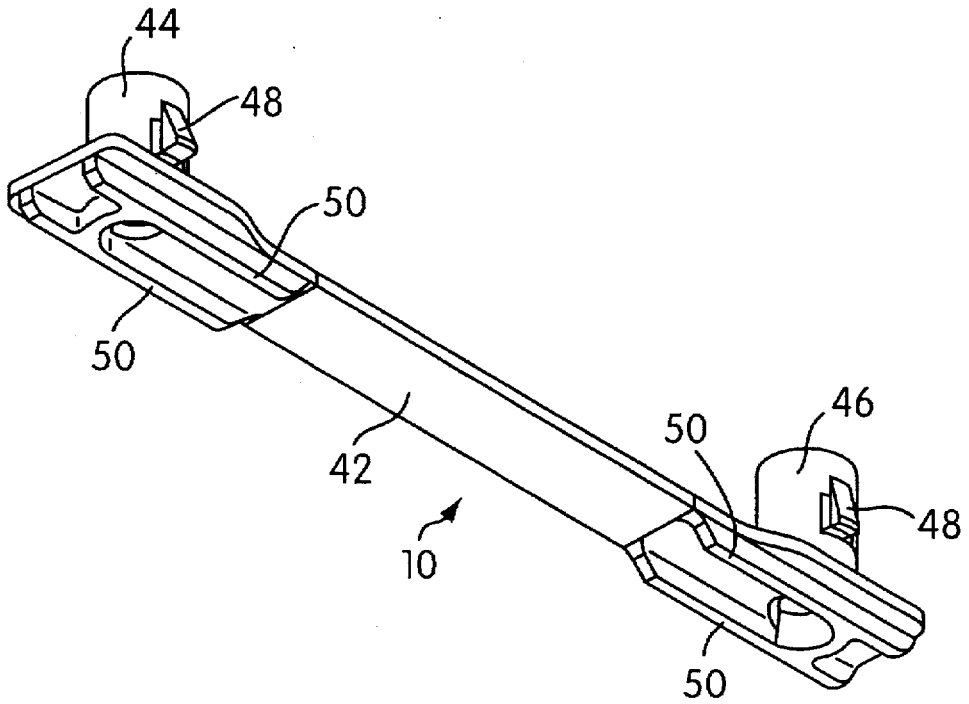
FIG. 4 is perspective view of the top side of the flexible link of FIG. 3.

Referring to FIGS. 3 and 4, flexible link 10 generally comprises a generally flexible planar section 42 having connectors comprising axially extending bosses 44 and 46 at opposite ends of the flexible link 10. Bosses 44 and 46 are generally cylindrical in shape and each has a pair of opposed resilient tangs 48 extending radially of the bosses. Each end of the top side of the flexible link 10 has longitudinally extending ribs 50.

Preferably, flexible link 10 is molded from a flexible low stretch plastic material. Preferred materials include HYTREL manufactured by Dupont.

The planar section 42 has a generally rectangular cross-section and a longitudinal extent which is greater than the width, which is greater than the thickness. The geometry of the planar section 42 biases the flexible link 10 to bend or flex primarily in the axial direction and not side to side. Further, since the ends of the flexible link 10 have ribs 50 which stiffen the ends relative to the planar section 42, only the intermediate portion of the flexible link 10 will deflect.

Referring to FIG. 2, the flexible link 10 is connected to cylinder lock 12 by inserting boss 44 through a bore in the remote end of lever 34. Boss 46 is inserted through a bore in the end of release pawl 52. Release pawl 52 is identical to release pawl 14 of the prior art latch except that the release pawl 52 merely has a bore for receiving boss 46. Bosses 44 and 46 are inserted through the respective bores overcoming the resiliency of the opposed tangs 48 to snap into place. Opposed tangs 48 retain the flexible link 10 to the cylinder lock 12 and the latch 40.

Latch 40 is otherwise identical to prior art latch 16, except that on latch 40 cam 54 is positioned in place of tab 32.

As is apparent to those skilled in the art, the cost of manufacture and assembly of the latch assembly incorporating the flexible link of the present invention is substantially less than the cost of the prior art latch assembly. The housing of the latch and the release pawl are simplified, as well as the method of assembling. The flexible link can easily be molded rather than the more costly cable assembly manufacture.

FIG. 2, illustrates the latch assembly in a stand-by condition. The flexible link 10 is biased to a deflected position. Release pawl 52 is in a latched position. In this condition, the deck lid on which the latch assembly is mounted may be closed. During closing, the detent fork 20 engages a keeper of a striker. As the detent fork rotates, it engages the release pawl 52 in a ratchet relation. Flexible link 10 will flex or bend further accommodating the movement of the release pawl 52 during engagement.

Figure 5:
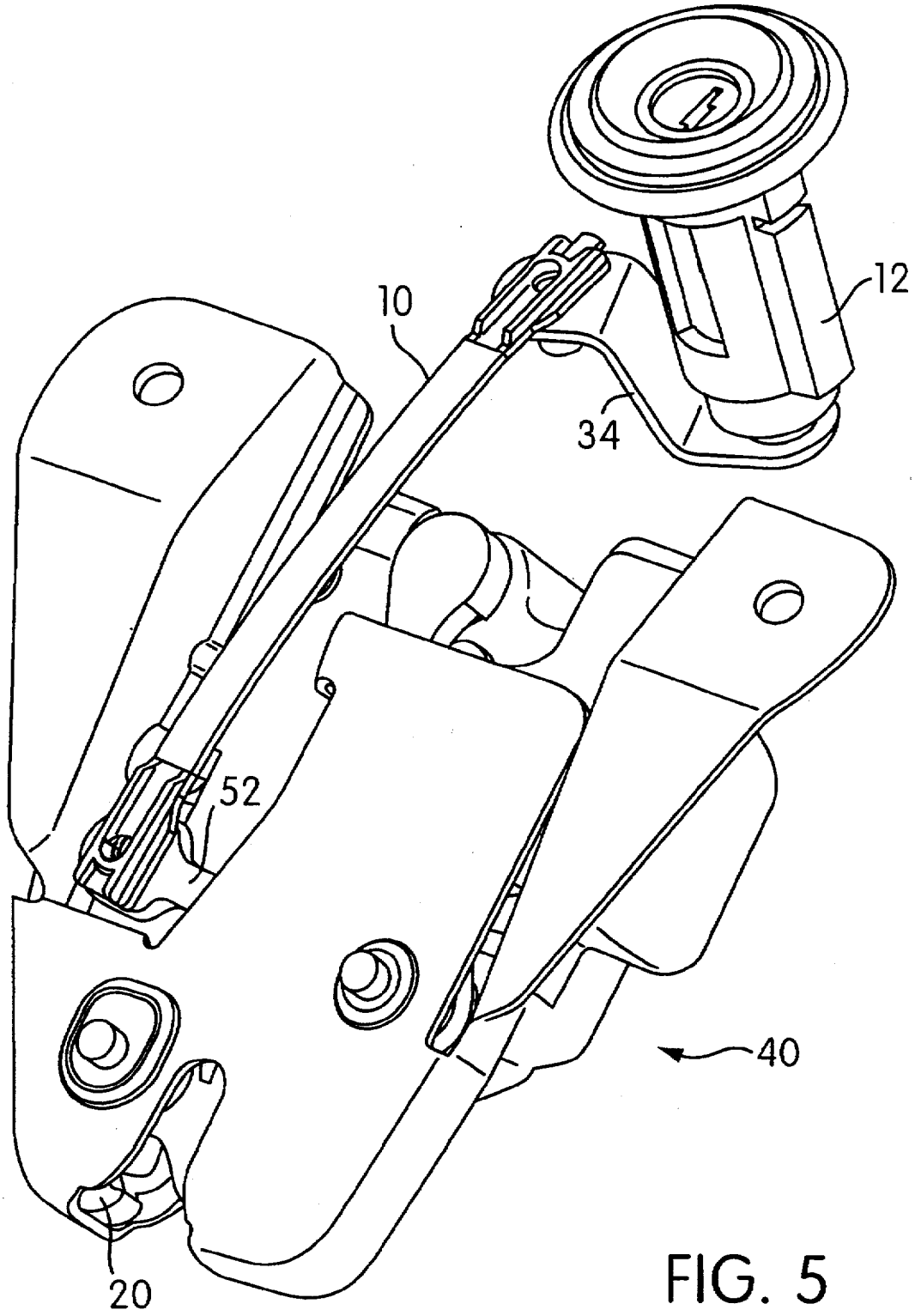
FIG. 5 is perspective view of the latch assembly of FIG. 2, illustrating the travel of the key cylinder pulling the flexible link taut.
Figure 6:
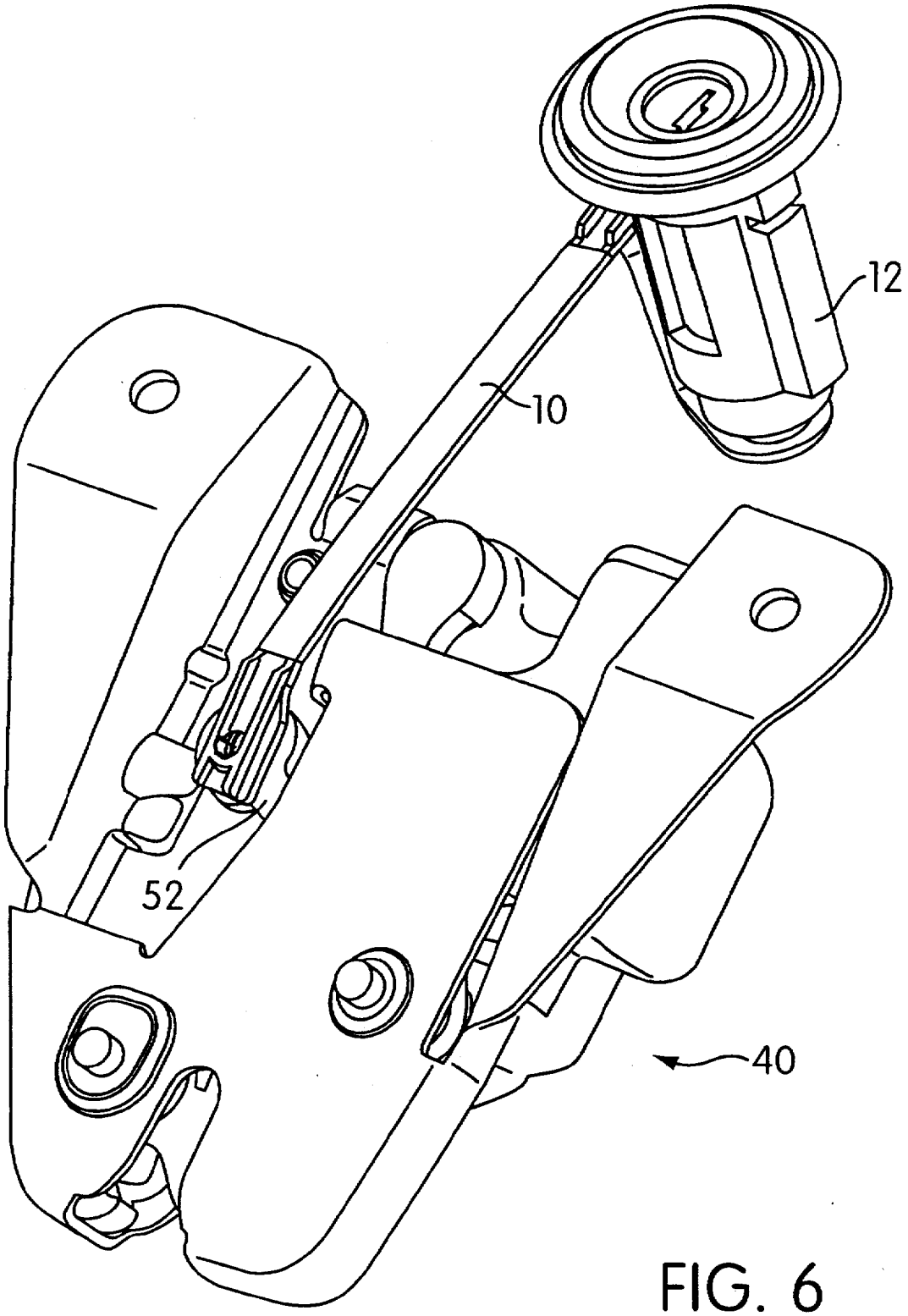
FIG. 6 is perspective view of the latch assembly of FIG. 2, illustrating the travel of the key cylinder rotating the pawl for releasing the detent fork.

Referring to FIG. 5, the lever 34 is rotated responsively to rotation of a key in key cylinder 12. Early rotation of key cylinder 12 will take up the slack in the flexible link 10 which will become tensioned once the pre-travel has been completed. Further rotation of the key lever 34 in a releasing sense will apply a releasing force to pawl 52 which will responsively rotate to a release position to release detent fork 20, as illustrated in FIG. 6. Upon release of the key in key cylinder 12, tension in flexible link 10 will be relieved, allowing release pawl 52 to return to the stand-by condition.

Cam surface 54 is positioned to engage planar section 42 during travel of the flexible link 10 between the stand-by and release positions. Cam surface 54 will have a height relative to the release pawl 52 and the key lever 34 such that cam surface 54 will prevent flexible link 10 from flattening. When the release pawl 52 is in the release position, flexible link 10 will be fully extended. However, cam surface 54 ensures that the flexible link 10 does not become planar and will induce at least a slight curvature therein. Since the flexible link 10 will have a bend, it will have a tendency or bias to bend outwardly relative to the latch 40 or axially relative to the longitudinal extent of the flexible link 10. In this manner, flexible link 10 will always return in a predictable manner to the stand-by position as illustrated in FIG. 2 and will not jam or inhibit movement of the key lever 34 or the release pawl 52.

Figure 7:
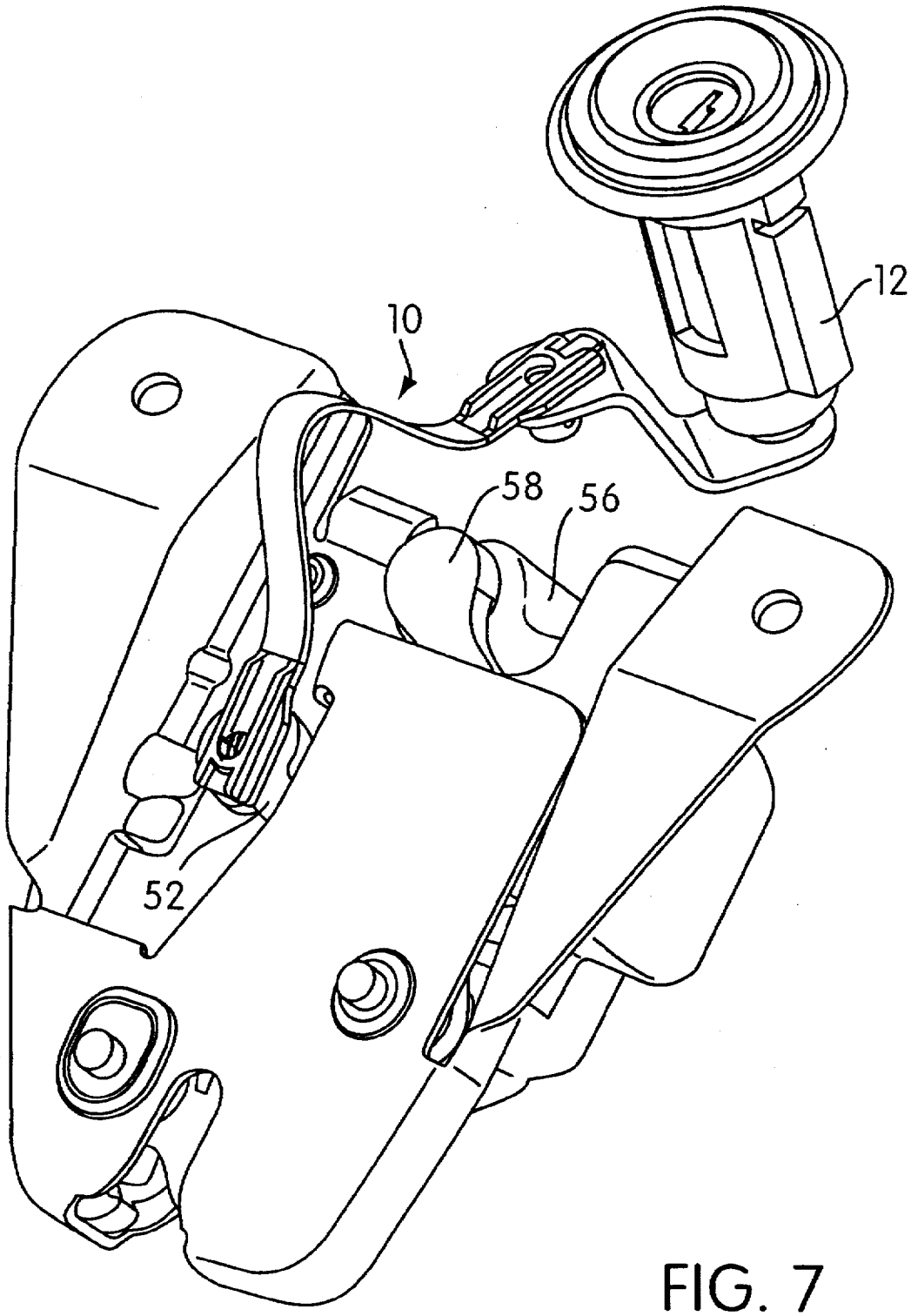
FIG. 7 is perspective view of the latch assembly of FIG. 2, illustrating the latch assembly in a power releasing condition.

Additionally, as shown in FIG. 7, the latch 40 may be provided with a power actuator 56 operably linked to release pawl 52 via lever 58. When activated, actuator 56 will rotate lever 58 causing release pawl 52 to rotate between the stand-by and the release positions. Since flexible link 10 is able to flex, the powered movement of the pawl 52 is independent of the key cylinder 12.

The preceding specific embodiment is illustrative of the practice of the present invention. It is to be understood, however, that other expedients known or apparent to those skilled in the art or disclosed herein may be employed without departing from the spirit of the invention.

We claim:

1. A latching system comprising:

a latch assembly comprising a detent member constructed and arranged to lockingly engage the latch assembly with a striker, said latch assembly further comprising a releasing member movable to a releasing position to release said detent member from locking engagement with said striker;

a key cylinder rotatable to move said releasing member to said releasing position to release said detent member from said locking engagement with said striker;

an elongated link molded from a plastic material so as to be formed with connecting portions at opposite ends thereof and a flexible intermediate portion between said connecting portions, said elongated link being connected at one connecting portion thereof to said releasing member and at an opposite connecting portion thereof to said key cylinder, said flexible intermediate portion being flexed into a curved condition when said detent member of said latch assembly is in said locking engagement with said striker, said flexible intermediate portion moving into a relatively straightened and tensioned condition when said key cylinder is rotated so as to move said releasing member to said releasing position, thereby releasing said detent member from said locking engagement with said striker.

2. A latching system according to claim 1, wherein said intermediate portion of said link is generally flat and is flexible in a direction generally perpendicular to a plane within which said intermediate flat portion lies, said link intermediate portion moving in a direction generally perpendicular to said plane when moving from said curved condition to said relatively straightened and tensioned condition when said key cylinder is rotated so as to move said releasing member to said releasing position, thereby releasing said detent member from said locking engagement with said striker.

3. A latching system according to claim 2, wherein said intermediate portion of said link is flexed in a predetermined direction when flexed into said curved condition, said latch assembly further comprising a cam member constructed and arranged to engage said generally flat intermediate portion of said link when said intermediate portion is disposed in said relatively straightened condition, said cam member preventing said link from moving to a perfectly straightened configuration and thus preventing said link from flexing in a direction opposite said predetermined direction when flexed into said curved condition.

4. A latching system according to claim 1, wherein said plastic material comprises a flexible, low stretch plastic material.

5. A latching system according to claim 1, wherein said connecting portions of said link are rigidly fixed to a lever member of said key cylinder and said releasing member, respectively.

6. A latching system according to claim 5, wherein said connecting portions of said link comprise projecting bosses received within respective openings in said lever member and said releasing member.

7. A latching system according to claim 6, wherein said projecting bosses comprise respective locking tangs constructed and arranged to snap radially outwardly beyond a diameter of said openings when said bosses are inserted through said openings to lock the ends of said link to said lever member and said releasing member.

8. A latching system according to claim 1, wherein said flexible link has a generally straight configuration when in a relaxed state.

9. A latching system comprising:

a latch assembly comprising a detent member constructed and arranged to lockingly engage the latch assembly with a striker, said latch assembly further comprising a releasing member movable to a releasing position to release said detent member from locking engagement with said striker;

a key cylinder rotatable to move said releasing member to said releasing position to release said detent member from said locking engagement with said striker;

an elongated link connected at one end thereof to said releasing member and at an opposite end thereof to said key cylinder, said link have a generally flat intermediate portion and being flexible in a direction generally perpendicular to a plane within which said intermediate flat portion lies, said intermediate portion being flexed into a curved condition when said detent member of said latch assembly is in said locking engagement with said striker, said link intermediate portion moving in said direction generally perpendicular to said plane into a relatively straightened and tensioned condition when said key cylinder is rotated so as to move said releasing member to said releasing position, thereby releasing said detent member from said locking engagement with said striker.

10. A latching system according to claim 8, wherein said intermediate portion of said link is flexed in a predetermined direction when flexed into said curved condition, said latch assembly further comprising a cam member constructed and arranged to engage said generally flat intermediate portion of said link when said intermediate portion is disposed in said relatively straightened condition, said cam member preventing said link from moving to a perfectly straightened configuration and thus preventing said link from flexing in a direction opposite said predetermined direction when flexed into said curved condition.

11. A latching system according to claim 9, wherein said link is molded from a flexible, low stretch plastic material.

12. A latching system according to claim 8, wherein said ends of said link are rigidly fixed to a lever member of said key cylinder and said releasing member, respectively.

13. A latching system according to claim 12, wherein said ends of said link comprise molded projecting bosses received within respective openings in said lever member and said releasing member.

14. A latching system according to claim 13, wherein said projecting bosses comprise respective locking tangs constructed and arranged to snap radially outwardly beyond a diameter of said openings when said bosses are inserted through said openings to lock the ends of said link to said lever member and said releasing member.

15. A latching system according to claim 9, wherein said flexible link has a generally straight configuration when in a relaxed state.

* * * * *